US005136995A

United States Patent [19]

Mayer

[11] Patent Number: 5,136,995

[45] Date of Patent: Aug. 11, 1992

[54] INTERNAL COMBUSTION PISTON ENGINE

[76] Inventor: Werner Mayer, Risshaldenweg 20, D-7313 Reichenbach a.F., Fed. Rep. of Germany

[21] Appl. No.: 683,882

[22] Filed: Apr. 11, 1991

[30] Foreign Application Priority Data

Apr. 12, 1990 [DE] Fed. Rep. of Germany ..... 4011862

[51] Int. Cl.[5] ..... F02B 13/08

[52] U.S. Cl. ..... 123/294; 123/435; 123/495

[58] Field of Search ..... 123/294, 304, 27 GE, 123/435, 531, 495, 508

[56] References Cited

U.S. PATENT DOCUMENTS

| | | | |
|---|---|---|---|
| 2,230,920 | 2/1941 | Wirtsen | 123/435 |
| 2,385,239 | 9/1945 | Unsworth | 123/435 |
| 2,799,263 | 7/1957 | French | 123/495 |
| 4,311,127 | 1/1982 | Mayer | 123/495 |

*Primary Examiner*—Andrew M. Dolinar
*Attorney, Agent, or Firm*—Max Fogiel

[57] ABSTRACT

An internal combustion piston engine for operation with gaseous and/or liquid fuel comprises at least first and second working cylinders associated with each other, with their working pistons movable in opposite relationship, and a fuel supply system which is operable to compress the fuel and which for each working cylinder has a piston compressor associated therewith at the cylinder head end. Each compressor has a cylinder and a differential piston axially movably accommodated in the compressor cylinder. The larger surface of the differential piston is subjected to the pressure in the combustion chamber of the associated working cylinder while the smaller surface of the differential piston is operable to compress the fuel when the pressure rises in the working cylinder combustion chamber. Extending between the compression chamber of the piston compressor and the combustion chamber of the associated working cylinder is at least one flow transfer path which has an opening into the combustion chamber, the opening being disposed in the path of movement of the differential piston and being adapted to be opened and closed by a control edge thereof. The differential pistons of the associated compressors are positively coupled in opposite relationship.

23 Claims, 8 Drawing Sheets

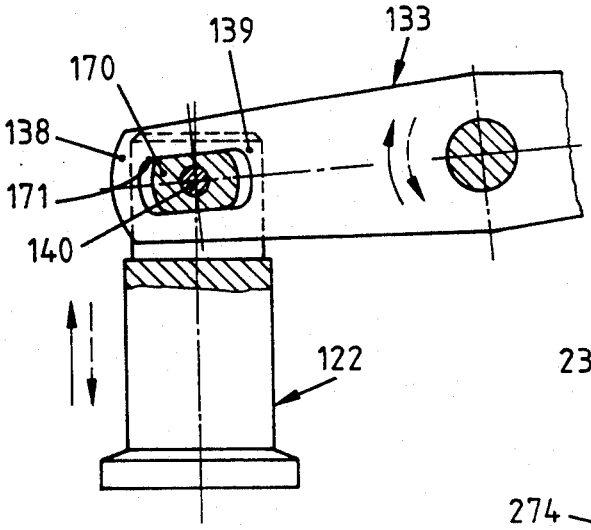
Fig. 6
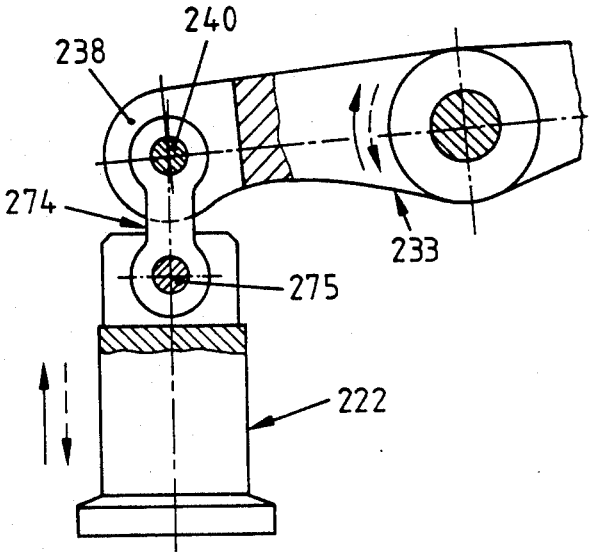
Fig. 7
Fig. 8
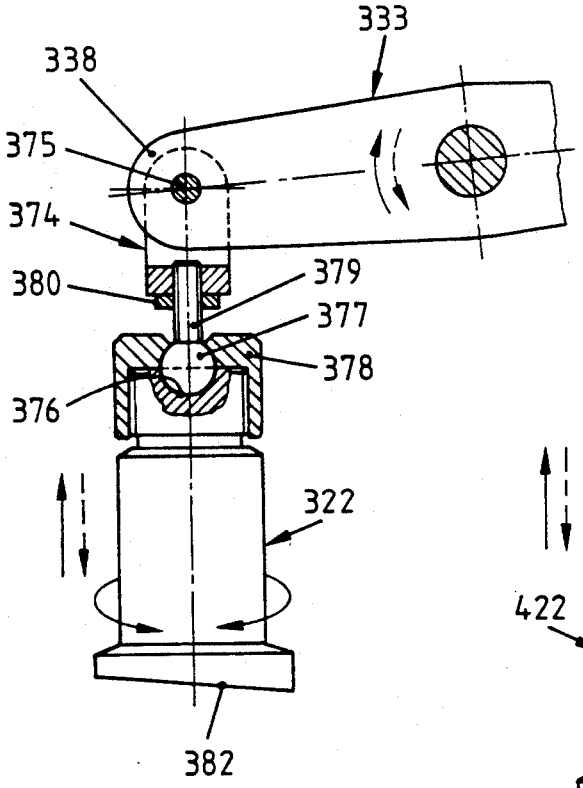
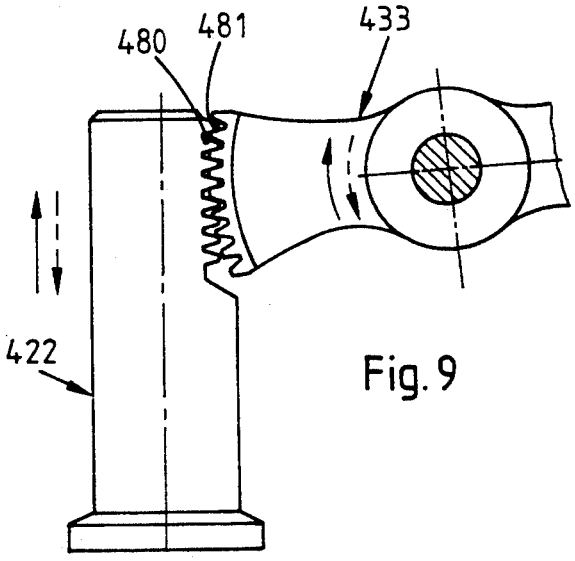
Fig. 9

INTERNAL COMBUSTION PISTON ENGINE

BACKGROUND OF THE INVENTION

One of the trends of development of the internal combustion engine generally has been to improve the efficiency thereof in such a way as to afford either improved fuel consumption or improved power output. Along those lines, one form of internal combustion piston engine, which can also be referred to as a reciprocating engine, for operation with gaseous and/or liquid fuel, which can be referred to generally for the sake of simplicity as a fluid fuel, comprises a fuel supply system which for compressing the fuel for each working cylinder of the engine has a piston-type compressor associated with the working cylinder at the cylinder head end thereof, the piston compressor comprising a compressor cylinder and a stepped or differential piston which is axially movably accommodated in the compressor cylinder and the larger area of which is subjected to the pressure of the combustion chamber of the associated working cylinder. The smaller area or surface of the stepped or differential piston of the respective piston compressor compresses the fuel when the pressure rises in the combustion chamber of the associated working cylinder. That arrangement comprises at least one flow transfer path which extends between a compression chamber of the piston compressor and the combustion chamber of the associated working cylinder and which has at least one opening or port into the combustion chamber. The port is disposed in the path of movement of the stepped or differential piston of the piston compressor and can be opened and closed by a control edge of that piston. An engine design configuration of that kind is to be found in German patent specification No. 2 826 807. In operation of that engine, in successive working cycles of the engine fuel in gaseous form is compressed by means of the respective piston compressor arranged in the cylinder head of a working cylinder, more specifically with its differential piston which can be subjected to the pressure in the combustion chamber at the larger area of the differential piston, with the fuel being injected, in accordance with a law which is not of specific interest in the present context, in a compressed and accordingly heated condition, into combustion air which is compressed in the combustion chamber of the associated working cylinder itself. The return movement of the compressor piston for a fresh working cycle thereof, and thus the intake of fuel into the compression chamber of the compressor, by a suction effect, are produced by means of a spring arrangement supporting the piston at the rear thereof, or by some other form of actuation thereof, providing for displacement thereof in the opposite direction to the compression stroke movement, when a low pressure obtains in the combustion chamber of the working cylinder of the engine.

SUMMARY OF THE INVENTION

An object of the present invention is to provide an internal combustion piston engine which affords increased efficiency with its attendant advantages and consequences.

Another object of the present invention is to provide an improved internal combustion piston engine which can operate under a wide range of operating conditions and which affords enhanced versatility of use.

Still another object of the present invention is to provide an internal combustion piston engine which can operate on a wide range of different fuels.

In accordance with the present invention, these and other objects are achieved by an internal combustion piston engine for operation with gaseous and/or liquid fuels, which can be referred to herein for the sake of simplicity as fluid fuel, comprising at least one pair of working cylinders operatively associated with each other, with oppositely movable working pistons, and further comprising a fuel supply system which for the compression of fuel for each working cylinder has a piston compressor associated with the working cylinder at the cylinder head end thereof. Each compressor comprises a cylinder and a stepped or differential piston which is axially movable in the compressor cylinder and the larger area of which is adapted to be subjected to the pressure in the combustion chamber of the associated working cylinder of the engine while the smaller area of the differential piston of the compressor compresses the fuel when the pressure rises in the combustion chamber of the working cylinder. The engine comprises at least one flow transfer path extending between the compression chamber of the compressor and the combustion chamber of the working cylinder, with the flow transfer path having at least one opening into the combustion chamber of the associated working cylinder. The opening is disposed in the path of movement of the differential piston and can be appropriately closed and opened by a control edge thereof. The stepped or differential pistons of the compressors of the associated working cylinders are positively coupled in opposite relationship.

As will be seen in greater detail hereinafter, the drive system for the compressor pistons of the respectively associated working cylinders, as outlined above, does not involve the use of springs to produce operating movements thereof so that the drive system permits the engine to be operated even at very high speeds of rotation and simplifies actuation and control thereof under a wide range of different operating conditions. The fact that the movements of the compressor pistons are produced by a positive coupling arrangement relative to each other, thus providing an enhanced drive effect for each thereof, also affords further possible uses for the engine, for example when operating same with different fuels. The fuel used for example may be a gaseous fuel or a fuel with gas added thereto, but the fuel may equally be a liquid fuel in vaporised or atomised form, with a wide range of different kinds of gas added thereto, for example including air or exhaust gas. In the compressor stroke movement of the fuel compressor, a part of the fuel may combine with oxygen in the gas mixture, produce heat and thereby vaporise the remainder of the liquid fuel, thus resulting in combustion substantially without the formation of soot particles.

The contributing factor towards that aim, in accordance with the invention, is the above-indicated cooperation of first and second working cylinders of the engine and in corresponding fashion also the compressor pistons of the fuel compressors associated with those working cylinders. The positive coupling of the compressor pistons in that design configuration provides for precise oppositely related operation of the two compressors in dependence on the oppositely related mode of operation of the working pistons in the working cylinders of the engine. It will be appreciated in that respect that the number of working cylinders in an engine according to the invention may be any appropriate integer.

Although it is readily possible to envisage many possible ways of positively coupling the co-operating differential pistons of a pair of fuel compressors in the engine according to the invention, in a preferred feature of the invention, which gives a particularly simple design layout, the differential pistons of the compressors of mutally associated working cylinders are respectively mechanically positively coupled in opposite relationship by way of a respective rocking lever, thus giving a precise coupling effect.

In accordance with a further feature of the invention, it has been found desirable for the ends of the rocking lever, which is pivotable about an axis extending perpendicularly to the axes of the compressor cylinders, to be pivotally connected to projections or extensions on the compressor pistons, which extend therefrom on the side remote from the associated working cylinder. Provided in the pivotal connecting region between the projections on the compressor pistons and the ends of the rocking lever are automatically operative means for compensating for stresses or constraints in the movement of the rocking lever.

Preferably, the above-mentioned compensating means are provided by the ends of the rocking lever being pivotally connected to the projections on the respective pistons by way of self-adjusting eccentric bearings, comprising a respective eccentric sleeve freely rotatably accommodated in a bearing opening in the rocking lever or projection on the piston, and a mounting journal or trunnion which passes through the respective eccentric sleeve and which is connected to the other of the rocking lever or the projection on the piston.

Alternatively, the above-mentioned compensating means may be provided by the ends of the rocking lever being pivotally connected to the projections on the pistons by way of a respective sliding member which is movable transversely with respect to the movement of the respective compressor piston and which in turn has a bearing journal or trunnion extending therethrough, to form the pivot mounting member for connecting the rocking lever to the respective compressor piston. In the oppositely directed upward and downward movement of the ends of the rocking lever therefore, the sliding members perform slight transverse movements in the guides provided therefor in the rocking lever.

In a preferable feature of that arrangement, the sliding members are slidably mounted in slot-type guides extending in the longitudinal direction of the rocking lever in the ends thereof, while the bearing journals or trunnions are fixedly mounted in the projections on the respective compressor pistons.

In another alternative configuration, the above-mentioned compensating means are provided by the ends of the rocking lever being pivotally connected to the projections on the respective compressor pistons by means of a respective link which is pivotally connected to the rocking lever on the one hand and to the respective projection on the piston on the other hand, the link extending substantially in the axial direction of the associated compressor piston. In that construction, in the upwardly and downwardly directed movements of the compressor piston, the associated link performs slight pivotal movements about its point of pivotal connection to the projection on the respective compressor piston.

In accordance with a preferred feature in that configuration, the link connecting a respective projection on a compressor piston to a respective rocking lever end is pivotally connected by means of a ball joint at one end and by means of a bearing journal or trunnion at the other end. When the compensating means are of such a configuration, the differential pistons of the compressors, which are pivotally connected to the ends of the respective rocking lever, can turn about their axis, namely the line along which they move, and that may appear to be an appropriate arrangement to adopt if the side of the compressor piston which faces towards the combustion chamber of the associated working cylinder of the engine is in the form of a control contour or profile which, depending on the respective rotational position of the corresponding differential piston, makes it possible to provide for a variation in the time at which fuel in a highly compressed and thus heated condition is supplied from the compressor into the combustion chamber of the respective working cylinder.

In a more specific and preferred development of the above-indicated configuration, the ends of the links which are towards the projections on the respective compressor pistons may be provided with a bearing ball, while the respective projections on the compressor pistons have bearing sockets accommodating the respective bearing balls.

In accordance with another preferred arrangement of the invention the ends of the respective rocking lever may be in the form of toothed segments and the projections on the respective compressor pistons may carry toothed rack portions which are in toothed engagement with the toothed segments on the respective rocking lever. That particular configuration of the means providing the operative interrelationship between the rocking lever ends and the projections on the respective compressor pistons does not require any particular means to compensate for the movement of the rocking lever ends, over portions of circular arcs, if the center point of the pitch circles defined by the toothed segments lies at the axis of pivotal movement of the rocking lever.

In accordance with another preferred feature of the invention, there is provided a separate drive which is derived from a cam shaft of the engine, for the differential pistons of the compressors, which pistons are positively coupled in opposite relationship by means of the rocking lever. The separate drive thus acts on the differential pistons, in addition to the larger areas of each thereof being acted upon by the pressure in the combustion chamber of the respectively associated working cylinder.

Preferably the above-mentioned separate drive may comprise a drive rocking lever which is adapted to be driven from the cam shaft by way of an actuating system comprising cam followers co-operating with the cams on the cam shaft, and pushrods. The drive rocking lever and the rocking lever providing for the positive intercoupling of the differential pistons of the respective fuel compressors are non-rotatably mounted on a common mounting shaft. As an alternative to that arrangement however the invention may preferably provide that the separate drive includes for each fuel compressor a drive rocking lever which is driven by a cam shaft and which engages the projection on the differential piston of the respective compressor, to provide a suitable operative connection by its one end with the associated differential piston. The drive effect for the drive rocking levers which is derived from the cam shaft can be by way of a suitable actuating system such as cam followers and pushrods, or alternatively by an overhead cam shaft. The rocking levers which are then operatively connected to the projections on the differential pistons of the associated fuel compressors can then be provided with a roller as a cam follower. That arrangement can also provide that the ends, which are remote from the differential pistons, of the drive rocking levers for providing the separate drive effect are mounted at adjustable pivot mounting locations, thus for example slidable rod or plunger members carried in the body of the engine.

The above-discussed configuration according to the invention which has an additional separate drive for the differential pistons of the fuel compressors, derived from a cam shaft of the engine, may in accordance with another development of the invention include a hydraulically operative separate drive with a respective pump driven by the cam shaft, and a hydraulic cylinder which is operatively connected to the pump by way of a hydraulic duct and which engages a projection on a respective compressor piston. In each working stroke movement of the hydraulic delivery pump which is driven by the cam shaft, the hydraulic cylinder associated with the pump is actuated and acts directly on the projection on the respective associated differential piston, thereby driving same in opposite relationship to the other differential piston which is positively coupled thereto. It is preferable in that arrangement for an adjustable damping member to be disposed in each of the hydraulic ducts.

In order to afford selective variability in regard to beginning the supply of fuel to a respective combustion chamber of the engine, the angle of rotation of the cam shaft may also be adjustable relative to the crankshaft of the engine.

Finally, the cams providing the separate drive referred to above may be of such a configuration that the supply of fuel to the respective combustion chambers of the engine occurs in accordance with a predetermined law.

It may be noted at this point that the internal combustion engine in accordance with the present invention may be in the form of a two-stroke or four-stroke engine.

Further objects, features and advantages of the invention will be apparent from the following description of preferred embodiments thereof.

BRIEF DESCRIPTION OF THE DRAWINGS

FIG. 6 is a view of a part of an engine according to the invention showing the pivotal connection of a compressor piston to a rocking lever by way of a sliding member accommodated slidably in a slot opening at the end of the rocking lever, FIG. 7 is a similar view to that shown in FIG. 6 illustrating the pivotal connection of a rocking lever end to a compressor piston by means of an interposed link, FIG. 8 is a similar view to that shown in FIG. 6 illustrating the pivotal connection of a rocking lever end to a compressor piston also by means of an interposed link, but with a ball joint provided at the end of the link towards the compressor piston, FIG. 9 shows a construction providing for positive coupling of a rocking lever to a compressor piston by way of a toothed rack associated with the latter, and a toothed segment at the rocking lever end, co-operating with the rack.

DESCRIPTION OF PREFERRED EMBODIMENTS

Figure 1:
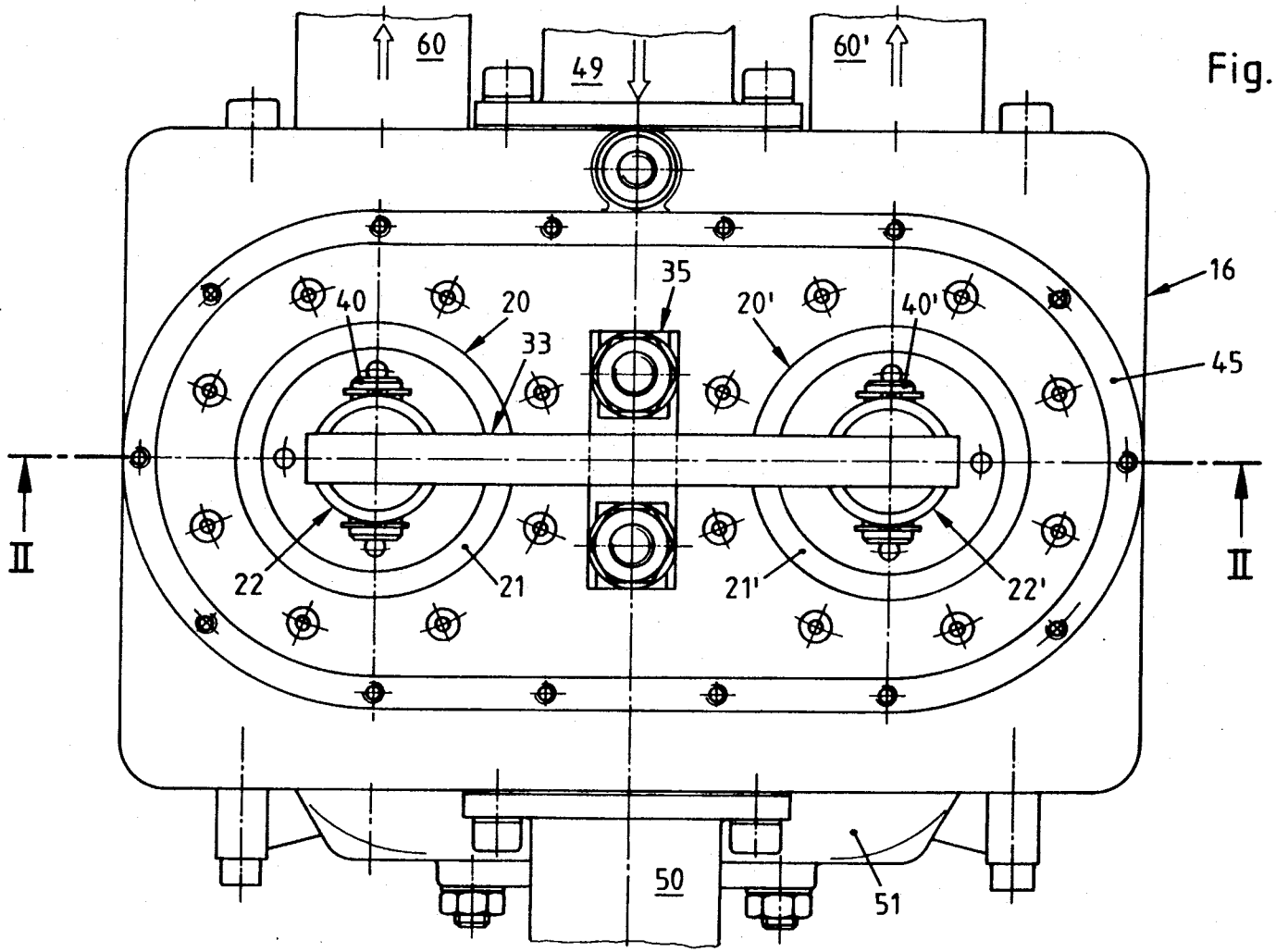
FIG. 1 is a plan view of an embodiment of the internal combustion engine according to the invention in the form of a twin cylinder engine, with a cylinder head cover omitted.
Figure 2:
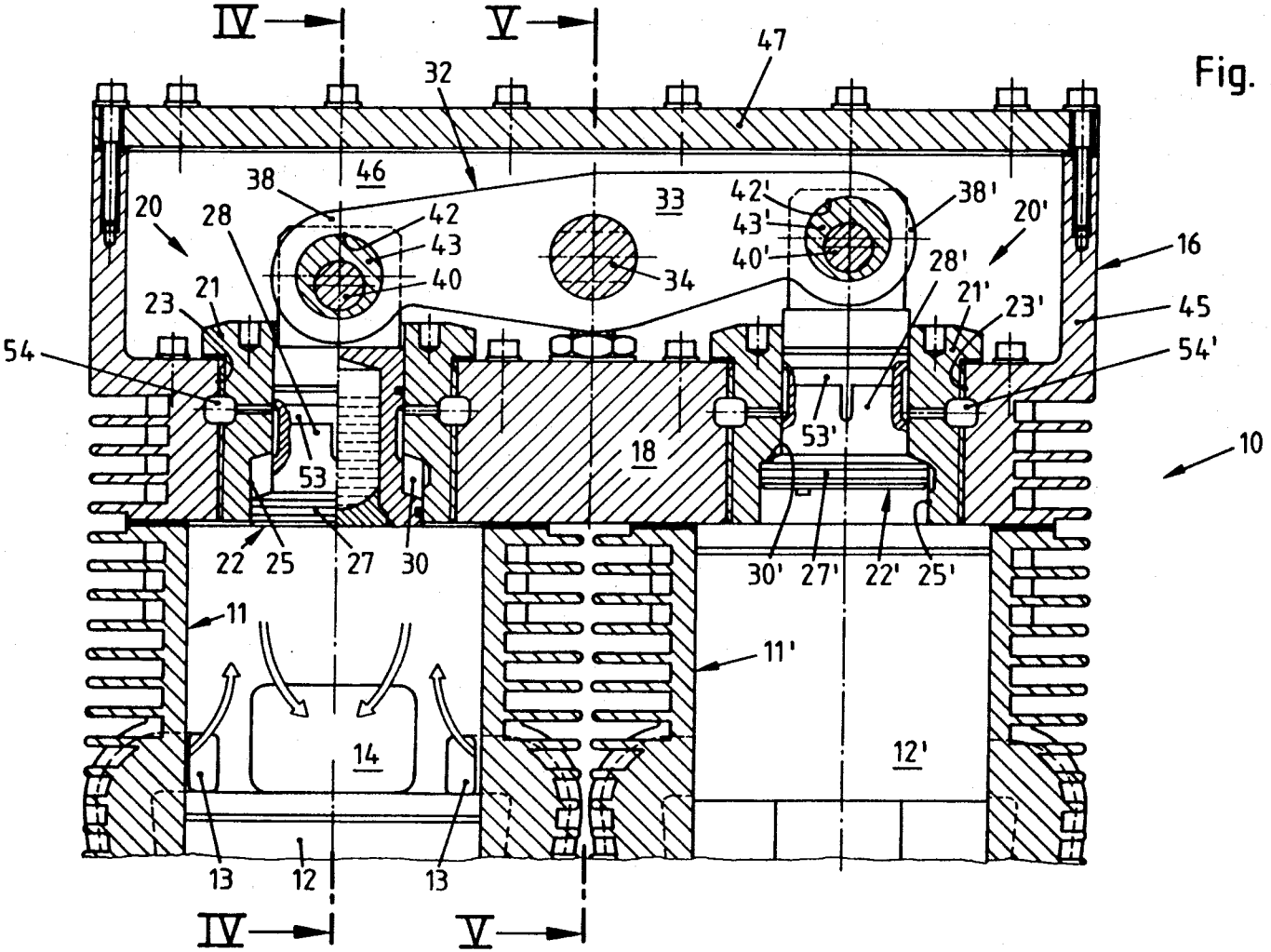
FIG. 2 is a view in longitudinal section taken along line II—II in FIG. 1 through the two working cylinders and the cylinder head of the engine, with a respective fuel compressor associated with each of the working cylinders at the cylinder head end thereof, and a rocking lever arrangement positively coupling the compressor pistons.

Referring firstly to FIGS. 1 through 5, shown therein is an internal combustion piston or reciprocating engine according to the invention, illustrated therein by way of example in the form of an air-cooled twin-cylinder two-stroke engine as generally indicated by reference numeral 10 in FIG. 2, with first and second working cylinders 11 and 11' which are disposed in side-by-side and parallel relationship, and first and second pistons 12 and 12' which are each slidably disposed in a respective one of the working cylinders 11 and 11' in opposite relationship to each other. Communicating with the interior of each of the working cylinders 11 and 11', by passing through the cylinder walls thereof, as can be clearly seen in relation to the working cylinder 11 shown at the left in FIG. 2, are supply or intake openings or ports 13 for combustion air or a fuel-air mixture, and exhaust openings or ports 14 for exhaust gases, the ports 13 and 14 being controlled in the usual fashion by the upper edge of each of the associated working pistons 12 and 12'. That arrangement does not need to be discussed in greater detail herein as it is generally known.

Carried on the working cylinders 11 and 11' is a cylinder head 16 which closes off the working cylinders at the top thereof. The cylinder head 16 comprises a cylinder head plate member 18 which is screwed in known manner to the working cylinders 11 and 11' with the interposition of suitable cylinder head gaskets 17. Disposed in the cylinder heat plate member 18 in coaxial relationship with each working cylinder is a piston compressor 20 and 20' respectively for compressing fuel and feeding it to the combustion chambers of the respective working cylinders. The fuel may be any suitable fluid fuel, for example a gaseous fuel, a fuel-air mixture, or a mixture of fuel and combustion exhaust gases, natural gas or hydrogen, without that constituting an exhaustive list of the fuels which may be used in the engine according to the invention.

The fuel compressors 20 and 20' are piston compressors each comprising a respective cylinder sleeve 21 and 21', and a stepped or differential piston 22, 22' which is axially slidably accommodated in the respective cylinder sleeve. The cylinder sleeves are screwed into openings 23 and 23' which extend through the cylinder head plate member 18 coaxially with respect to the two working cylinders 12 and 12'. The cylinder sleeves 21 and 21' are provided with stepped cylinder bores 24, 25 and 24', 25' respectively, more specifically in such a way that the bore portion 24, 24' which is remote from the respective working cylinder 11 and 11' respectively is of smaller diameter than the bore portion 25 and 25' which is towards the associated working cylinder. In a configuration corresponding to the stepped configurations of the cylinder bores 24, 25, 24', 25', the pistons 22 and 22' each comprise a piston portion 27 and 27' which is towards the associated working cylinder and which is fluid-tightly guided in the larger cylinder bore portion 25, 25', and a second piston portion or shank 28, 28' which is of smaller diameter than the first piston portion 27, 27' and which is fluid-tightly guided in the bore portion 24, 24' which is remote from the respectively associated working cylinder 11, 11'. It will be noted at this stage that the drawing diagrammatically indicates only two piston rings on each compressor piston, for producing the sealing effect in relation thereto, in the respective compressor cylinder.

The compressor pistons are differential pistons and the compression chambers 30 and 30' defined thereby, for compressing the fuel to be fed to the engine, are disposed in the region of the larger-diameter portions 25 and 25' of the cylinder sleeves, which are closed off by the larger-diameter piston portion 27, 27', on the side of the compression chambers 30, 30' which faces towards the respective working cylinder.

Figure 3:
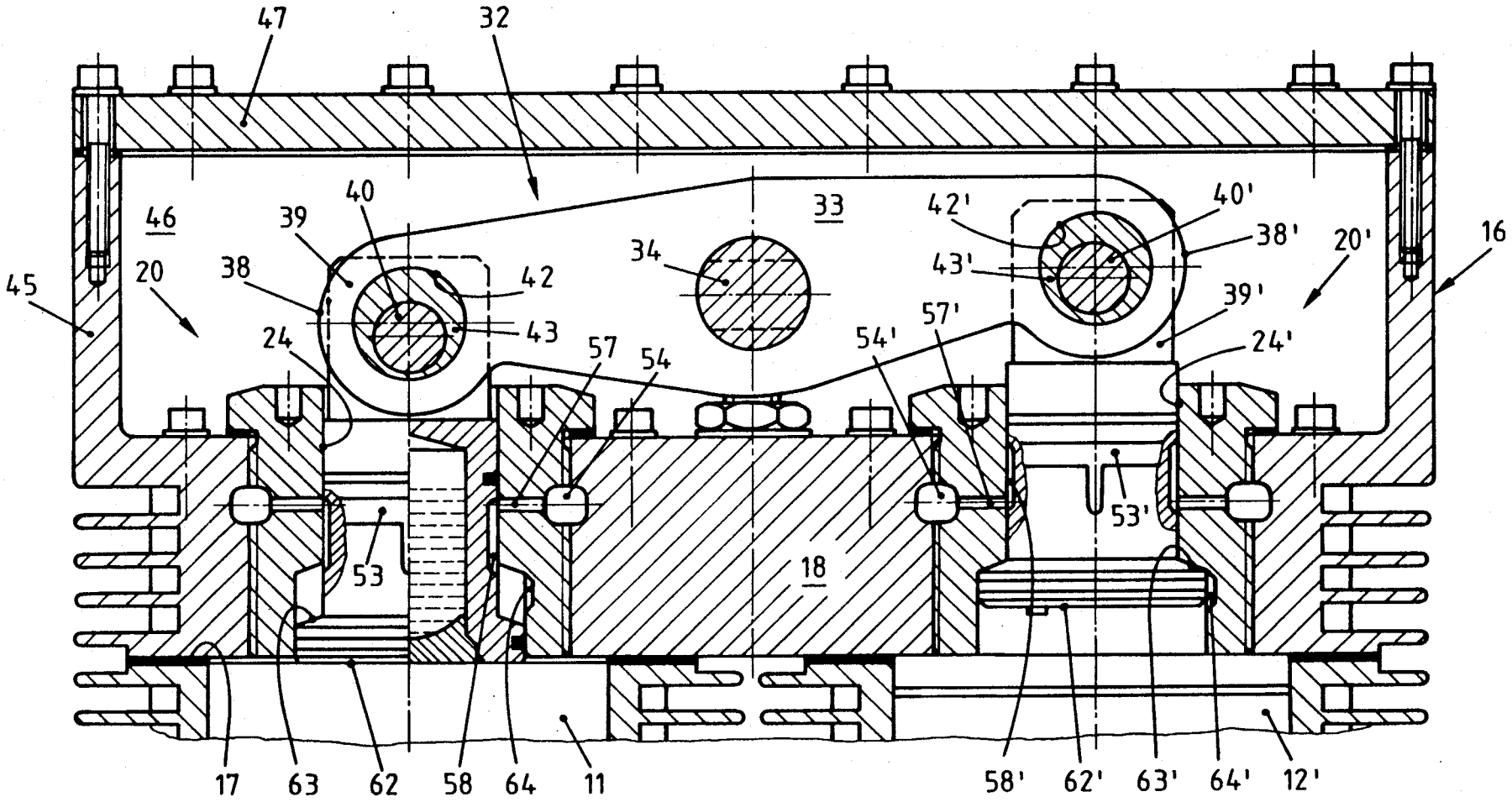
FIG. 3 is a view on an enlarged scale of a portion from FIG. 2.
Figure 4:
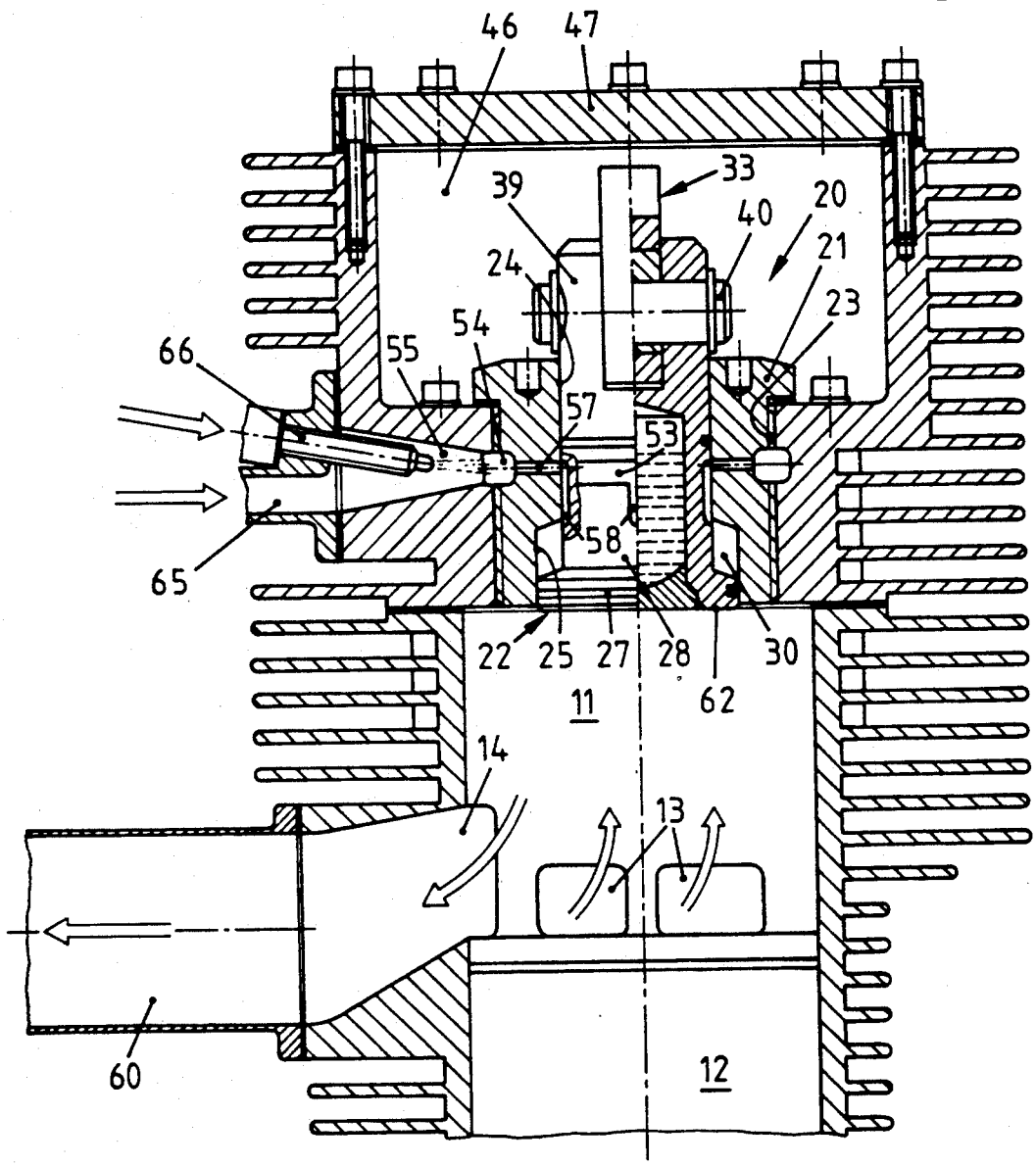
FIG. 4 is a view in cross-section taken along line IV—IV in FIG. 2 through the cylinder head and a cylinder of the internal combustion engine.

The compressor pistons 22 and 22' of the fuel compressors 20 and 20' associated with the two working cylinders 11 and 11' are positively coupled in opposite relationship by means of a rocking lever arrangement which is generally indicated by reference numeral 32 in for example FIGS. 3 and 4. The rocking lever arrangement 32 includes a rocking lever 33 which is carried on a mounting unit indicated at 35 in FIG. 1, pivotably about a mounting axis indicated at 34 in FIGS. 2 and 3, in symmetrical relationship to the axes of the working and compressor cylinders. The mounting unit 35 is in turn arranged adjustably in respect of height on studs indicated at 36 and 36' in FIG. 5, which are screwed to the cylinder head plate member 18, and forms the mounting axis 34 for the rocking lever 33, said axis extending perpendicularly to the cylinder axes. The differential pistons 22 and 22' of the fuel compressors 20 and 20' respectively are pivotally connected to the ends 38 and 38' of the rocking lever 33, which are remote from the mounting axis 34. For that purpose, forked projections 39 and 39', the forked configuration of which can be clearly seen from FIG. 4, extend away from the portions 28 and 28' of the respective differential pistons 22 and 22', on the side thereof remote from the respective working cylinders. The ends 38 and 38' of the rocking lever 33 are accommodated between the forked configurations of the prospective projections 39 and 39'. The pivotal connection is made by means of bearing trunnions or journals 40 and 40' which pass through the projections 39 and 39' and the ends 38 and 38' of the rocking lever.

The ends 38 and 38' of the rocking lever 33 have openings 42 and 42' which pass therethrough and which accommodate eccentric bearings 43 and 43' which in turn have the mounting trunnions 40 and 40' passing therethrough. The mounting trunnions 40 and 40' are fixedly mounted in the forked projections 39 and 39' of the piston portions 28 and 28'. Upon upward and downward movement of the stepped pistons 22 and 22' therefore, the eccentric bearings 43 and 43' experience a limited rotary movement in the mounting openings 42 and 42' in which they are accommodated. That automatically eliminates stresses and constraints which otherwise would necessarily occur at the connections between the ends of the rocking lever and the compressor pistons, because the ends of the rocking lever 33 move along circular arcs.

In view of the above-discussed positive coupling between the compressor pistons 22 and 22' by means of the rocking lever 33 carried on the mounting unit 35 on the cylinder head plate member 18, the compressor pistons of the fuel compressors 20 and 20' can only perform oppositely directed movements.

Figure 5:
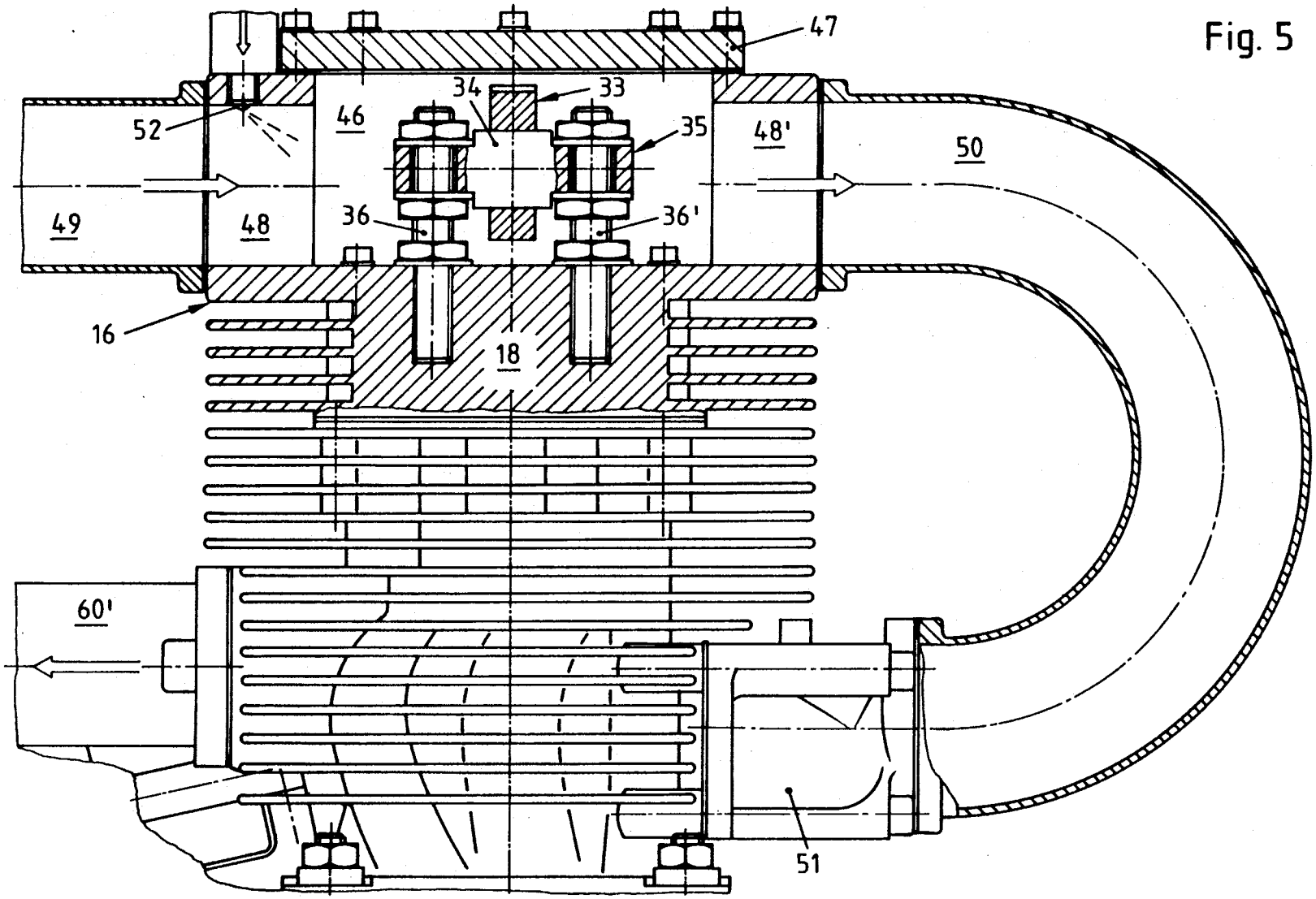
FIG. 5 is a view in cross-section taken along line V—V in FIG. 2 through the cylinder head of the internal combustion engine.

Looking now at FIGS. 2 and 3, the cylinder head plate member 18 has external wall portions 45 which extend upwardly therefrom in FIGS. 2 and 3, that is to say away from the working cylinders 11 and 11', on the side of the cylinder head plate member 18 which is remote from the working cylinders. The wall portions 45 enclose a cavity 46 which accommodates the rocking lever arrangement 32 and which is closed at its top by means of a cover 47 which can be screwed to the wall portions 45. As shown in FIG. 5, air ducting passages 48 and 48' pass through the wall portions 45 which extend upwardly away from the cylinder head plate member 18, in symmetrical relationship with the fuel compressors 20 and 20' which are disposed in the cylinder head. It may be noted at this point that instead of air, it is also possible to feed the working cylinders 11 and 11' with a fuel-air mixture, but that does not in any way alter the mode of operation of the engine according to the invention, in this respect.

Reverting now to the description of the air ducting passages 48 and 48', while the one air ducting passage 48 communicates with an air supply duct 49, the other air ducting passage 48 communicates with a bend 50 which extends in an arcuate configuration downwardly into the region of the working cylinders 11 and 11' and which is connected to a branching member 51 which in turn communicates with the air intake openings or ports 13 of the working cylinders 11 and 11'. Having regard to that arrangement, the combustion air which flows into the working cylinders 11 and 11', in dependence on the reciprocating movement of the working pistons 12 and 12', is passed through the space 46 in the cylinder head, which accommodates the rocking lever arrangement 32. In addition, an injection nozzle 52 for injecting lubricating oil into the combustion air opens into the air ducting or intake passage 48 which communicates with the air supply duct 49. The particles of lubricating oil which are thus entrained in the combustion air can also provide for lubrication of the parts of the engine in the crankcase thereof.

Reference will now be made more specifically to FIGS. 2 through 4 showing that the cylinder head plate member 18 and/or the cylinder sleeves 21 and 21' of the fuel compressors 20 and 20' are provided with radial annular grooves 54 and 54' approximately at the middle of the longitudinal extend of the cylinder bores 24 and 24' which carry the piston portions 28 and 28', and a transverse bore indicated at 55 in FIG. 4, which extends through the cylinder head plate member 18, communicates with the respective annular grooves 54 and 54'. As shown in FIG. 4, communicating with the bore 55 are the supply duct 65 for gaseous or vaporised fuel or gas constituents of a fuel mixture, and the supply duct 66 for the supply of liquid fuel. It will be appreciated that gaseous and/or liquid fuel may also be brought together in a different manner and may then pass jointly into the transverse bore 55. Extending radially inwardly from the annular grooves 54 and 54' are respective pluralities of circumferentially distributed radial bores 57 and 57' which open within the respective cylinder bore 24, 24' which carries the piston portion 28, 28' of the respective compressor pistons. Annular grooves 53 and 53' and longitudinally extending grooves 58 and 58' are provided in the respective piston portions 28 and 28' in a corresponding number and in a similarly circumferentially distributed arrangement, and each terminate on the side remote from the associated working cylinder 11 and 11', in front of the piston ring which is carried on the respective piston portion 28, 28', and extend towards the larger-diameter portions of the respective differential pistons 22 and 22' to such an extent that the compression chambers as indicated at 30 and 30' in for example FIG. 2 of the respective fuel compressors communicate with the respective annular groove 54, 54' in the cylinder sleeves 21 and 21', when the respective piston 22, 22' is in its downward position. That downward position on the part of the compressor pistons is shown in the left-hand half of each of FIGS. 2 and 3.

When the compressor pistons 22 and 22' move out of their above-mentioned downward position towards the side which is remote from the associated working cylinders 11 and 11', the longitudinal grooves 58 and 58' which form flow transfer passages move into positions such that the ends thereof which are towards the larger-diameter piston portions 27 and 27' pass into the region of the cylinder bores 24 and 24' carrying the piston portions 28 and 28', whereby the compression chambers 30 and 30' of the piston compressors are closed off from the respective annular groove 54, 54' in the cylinder sleeve 21, 21', which provides the supply of fuel.

FIG. 4 and the left-hand half in each of FIGS. 2 and 3 show the working piston 12 of the working cylinder 11, which is illustrated on the left in FIGS. 2 and 3, in its lowermost position in which the exhaust outlet port 14 and the air inlet port 13 are open. That arrangement of the ports 14 and 13 shows that, when the working piston 12 is going down, firstly the exhaust port 14 is opened and then the air inlet ports 13 are opened only upon further downward movement of the working piston. Accordingly, the exhaust gases firstly flow out of the combustion chamber of the working cylinder after the exhaust port 14 is opened, being discharged by way of an exhaust pipe 60, 60' suitably connected to the working cylinder, before the working piston opens the air inlet ports 13 and fresh air bearing injected lubricating oil therein flows into the working cylinder, also displacing any remaining exhaust gases therefrom.

In a manner corresponding to the position of the working piston 12 of the working cylinder 11 which is shown on the left in FIG. 2, the differential piston 22 of the fuel compressor 20 which is associated with that working cylinder 11 is also in its lowermost position in which the annular groove 54 in the cylinder sleeve 21, the groove 54 communicating with a fuel supply duct (not shown), is communicated with the compression chamber 30 of the fuel compressor by way of the radial bores 57, the annular groove 53 and the longitudinal grooves 58 in the piston portion 28. In that operating position the compressor piston 22 has sucked fuel into the compression chamber 30 from the moment at which the lower ends of the longitudinal grooves 58 have moved beyond the upper end of the compression chamber 30.

FIG. 2 shows that, when the working piston 12 of the one working cylinder 11 is down and the differential piston 22 of the fuel compressor 20 associated with that working cylinder 11 is also down in a corresponding fashion, the working piston 12' of the other working cylinder 11' and accordingly also the differential piston 22' of the other associated fuel compressor 20' are in their up position.

In the upper position of the working piston 1', which is shown in the right-hand half in FIG. 2, the combustion air which is enclosed in the combustion chamber of that working cylinder is highly compressed and the pressure of that highly compressed combustion air acts against the underside of the differential piston 22', on the larger area thereof as indicated by reference numeral 62' in FIG. 3. The differential piston 22' acts by means of its smaller annular surface 63', which is towards the compressor chamber 30' of the fuel compressor 20', on the gaseous fuel which is enclosed in the compression chamber 30' and compresses same until the lower edge of the differential piston 22', which is towards the working cylinder, opens at least a flow transfer opening 64' which extends from the compression chamber 30' towards the working cylinder, and the highly compressed and thus heated fuel flows by way of the flow transfer passage into the combustion chamber of the working cylinder.

When the compressed fuel flows into the also compressed combustion air, self-ignition occurs. The combustion gases which are propagated in the combustion phenomenon then produce a downward movement of the respective working piston while the working piston of the other cylinder experiences an upward movement and, in thus moving upwardly, compresses combustion air enclosed in the associated working cylinder. As soon as the downwardly moving working piston in the one working cylinder has moved beyond the exhaust port in that cylinder, there is an abrupt relief of pressure in that working cylinder, with the result that the differential piston of the associated fuel compressor performs a downward movement, in view of the positive coupling to the differential piston of the other fuel compressor and the application of pressure to the underside of that differential piston. The result of that is that fuel is drawn into the compression chamber of that fuel compressor while at the same time fuel compression takes place in the compression chamber of the other compressor.

Reference will now be made to FIG. 6 showing a detail of a construction of an internal combustion engine according to the present invention. Thus, shown in FIG. 6 is a form of pivotal connection between the end 138 of a rocking lever 133 and the projection 139 on a differential piston 122 of a fuel compressor, a detailed description of which will not be repeated at this point. The end 138 of the rocking lever 133 is pivotally connected to the projection 139 by way of a sliding member 170 which is accommodated for reciprocating sliding movement in a guide slot 171 disposed at the end of the rocking lever 133 and extending in the longitudinal direction thereof. A mounting journal or trunnion 140 passes through the sliding member 170, and is fixedly mounted to the projection 139 of the differential piston 122, thereby providing the actual pivotal connection between the differential piston and the rocking lever 133. The sliding member 170 which is reciprocatingly slidably accommodated in the guide slot 171 at the end 138 of the rocking lever 133 provides that constraints and stresses in the pivotal movements of the rocking lever about its mounting axis are avoided in the same manner as achieved in the above-described embodiment shown in FIGS. 1 through 5, by virtue of the eccentric bearings 43 and 43'.

The embodiment shown in FIG. 7 differs from that shown in FIG. 6 in that a link 274 is disposed between the end 238 of the rocking lever 233 and the adjoining portion of the differential piston 222 of the fuel compressor. The link 274 is pivotally connected to the end 238 of the rocking lever 233 and to the projection on the differential piston 222 by means of respective bearing trunnions or journals 240 and 275 respectively. The link 274 extends substantially in the direction of the axis of the compressor cylinder and accordingly in the direction of movement of the differential piston. As the pivotal connecting point formed by the trunnion 240 which affords the connection between the end of the rocking lever and the link 274 moves along an arcuate path in the upward and downward movements of the rocking lever 233 about its pivot mounting axis, the link 274 is subjected in operation to minor pivotal movements about its pivot mounting axis on the projection on the differential piston 222, thereby avoiding constraints and stresses between the differential piston and the rocking lever.

The embodiment shown in FIG. 8 also provides that the end 338 of the rocking lever 333 is connected to the projection on the differential piston 322 by means of a link 374 which is pivotally connected to the end of the rocking lever 333 by way of a bearing trunnion or journal 375, and a bearing ball 377 accommodated in a bearing socket 376 on the projection on the differential piston 322. The bearing ball 377 is held in the bearing socket 376 by means of a cap 378 which is screwed on to the projection on the differential piston 322 and which is in the form of a cap nut. A shank portion 379 of the link 374, which extends away from the bearing ball 377, passes through the cap 378 and is screwed to the end of the link 374 which is remote from the bearing trunnion 375, and secured by means of a lock nut 380. In view of the pivot mounting connection to the projection on the differential piston 322 being in the form of a ball joint, the differential piston of the fuel compressor is rotatable about its longitudinal axis. That consideration can be used in relation to a further function as will now be described: at its end which is towards the combustion chamber of the associated working cylinder, the differential piston 322 illustrated in FIG. 8 has an inclinedly extending control surface or edge indicated at 382. By rotation of the differential piston about its longitudinal axis, the control edge 382 makes it possible to adjust the moment of opening of the flow transfer passages from the compression chamber of the fuel compressor to the combustion chamber of the associated working cylinder, and thus to control the supply of fuel to the combustion chamber of that working cylinder, as well as controlling compression and heating of the fuel.

In the embodiment shown in FIG. 9, the projection on the differential piston 422 is provided with or is in the form of a toothed rack 480 and the end of the rocking lever 433 is in the form of a toothed segment 481 co-operating with the rack 480. The pitch circle center of the toothed segment 481 is at the pivot axis of the rocking lever 433 so that this construction does not require any measures to reduce or prevent constraints occurring as between the rocking lever and the differential piston upon movement of those components.

In the embodiments described hereinbefore the differential pistons of the two fuel compressors associated with a pair of cylinders, which pistons are positively coupled by means of a rocking lever pivotable about a mounting axis, are driven solely by virtue of their surfaces which face towards the combustion chambers of the respectively associated working cylinders being alternately subjected to pressure. In contrast, FIG. 10, to which reference is now directed, illustrates a construction of the engine according to the invention with a separate drive for the positively coupled differential pistons of two mutually associated fuel compressors, derived from a cam shaft $50^0$ of the internal combustion engine. The separate drive serves to support and promote compression of the fuel by the piston compressors, stabilises the movements thereof, and provides for precise control of the way in which the combustion procedure takes place.

Figure 10:
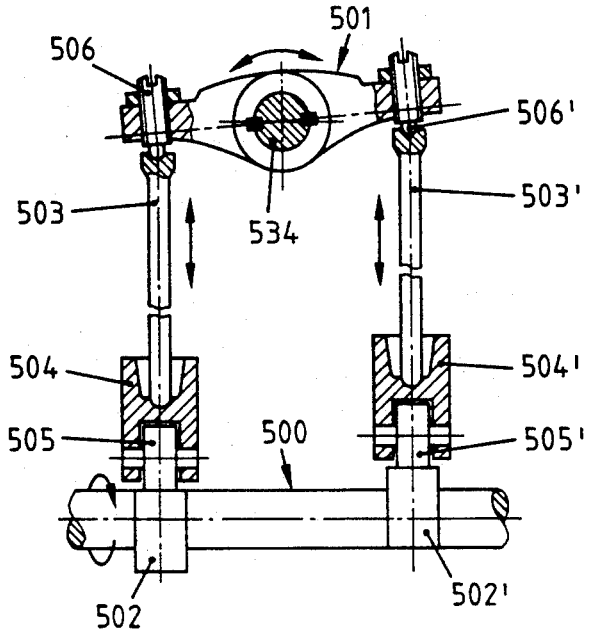
FIG. 10 shows a separate drive, which is derived from a cam shaft of the engine, for two positively coupled compressor pistons.

In the FIG. 10 construction, the rocking lever which provides for the positive coupling between the differential pistons (not shown) of the fuel compressors is non-rotatably carried on a mounting shaft 534 which also non-rotatably carries a further rocking lever 501 which is disposed at an axial spacing from the first-mentioned rocking lever for producing the positive intercoupling of the differential pistons. The further or drive rocking lever 501 is driven in per se known manner from the cam shaft 500 which has eccentric cams 502 and 502' thereon, by way of an actuating assembly comprising pushrods 503 and 503' and cam followers 504 and 504', with rollers 505 and 505'. Adjusting screws 506 and 506' are provided in the drive system to adjust the clearances therein, in the usual fashion which therefore does not need to be described in detail herein.

As the drive rocking lever 501 is non-rotatably connected to the rocking lever which provides the positive coupling effect between the differential pistons, the drive to the drive rocking lever 501 which comes from the cam shaft 500 is thus transmitted to the differential pistons and thus has a supporting effect in addition to the pressure acting on the actuation surface of the respective compressor pistons, which face towards the respective combustion chamber of the associated working cylinder of the engine according to the invention.

Figure 11:
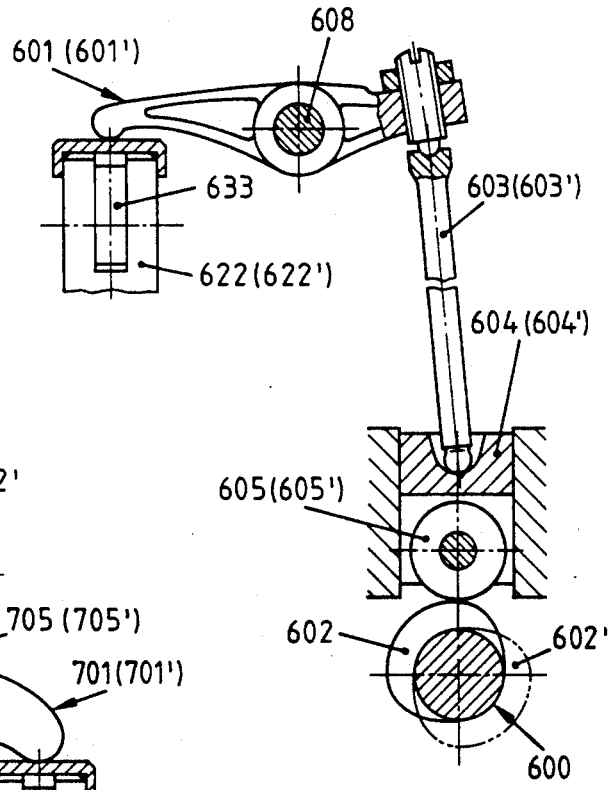
FIG. 11 shows an embodiment which is an alternative to the construction shown in FIG. 10, for the drive for the compressor pistons, derived from a cam shaft.

The construction shown in FIG. 11 also shows a cam shaft 600 of the internal combustion engine, from which there is derived a separate drive for the differential pistons 622 and 622' which moreover are positively coupled by means of a first rocking lever diagrammatically indicated at FIG. 11 at 633, in such a fashion that a projection on a respective differential piston of a respective fuel compressor is engaged by a further drive rocking lever 601. The drive lever 601 is pivotable about a pivot axis 608 and is in turn driven by way of a pushrod 603 and a tappet member 604 by way of a cam follower 605 acted upon by the eccentric cam 602 on the cam shaft 600. The separate drive system for the second differential piston 622' is of the same layout and the further drive rocking lever 601' associated with the separate drive for the second differential piston is carried on the same axis 608 as the rocking lever 601 shown in the drawing, and is driven by a further cam 602' in a similar fashion.

Figure 12:
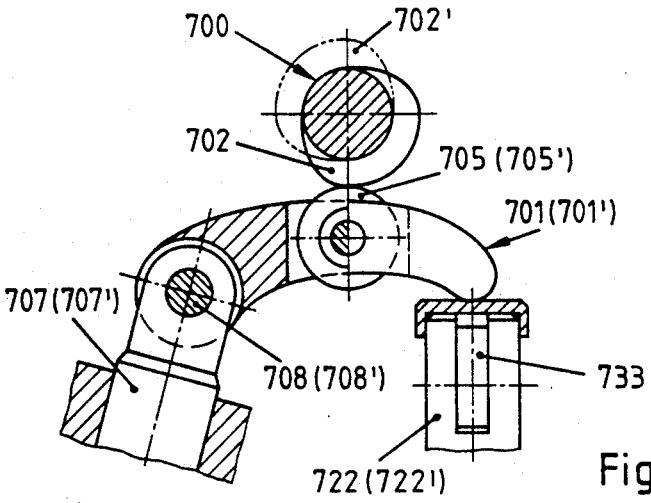
FIG. 12 shows another alternative configuration of a separate drive for the compressor pistons derived from an overhead cam shaft.

Reference will now be made to FIG. 12 showing a separate drive, as an alternative to that shown in FIG. 11, for the differential pistons 722 and 722' which in turn are positively coupled by way of a rocking lever 733. The separate drive in this construction is derived from an overhead cam shaft 700. The drive rocking lever 701 shown in FIG. 12 is connected at one end to the projection on the respective differential piston and is pivotally mounted at its other end by means of a pivot shaft or spindle 708 on an adjustable member 707 substantially in the form of a rod or plunger suitably carried in a part of the engine body. Approximately at the center of its longitudinal extent the drive rocking lever 701 carries a cam follower roller 705 co-operating with the respective eccentric cam 702 on the cam shaft 700. The separate drive which operates the second differential piston of the fuel compressors which are associated with each other in pairs in the manner described above in greater detail with reference to FIGS. 1 through 5 is of a simimlar configuration but lies behind the rocking lever assembly shown in FIG. 12 and is driven by a further cam 702' on the cam shaft.

Figure 13:
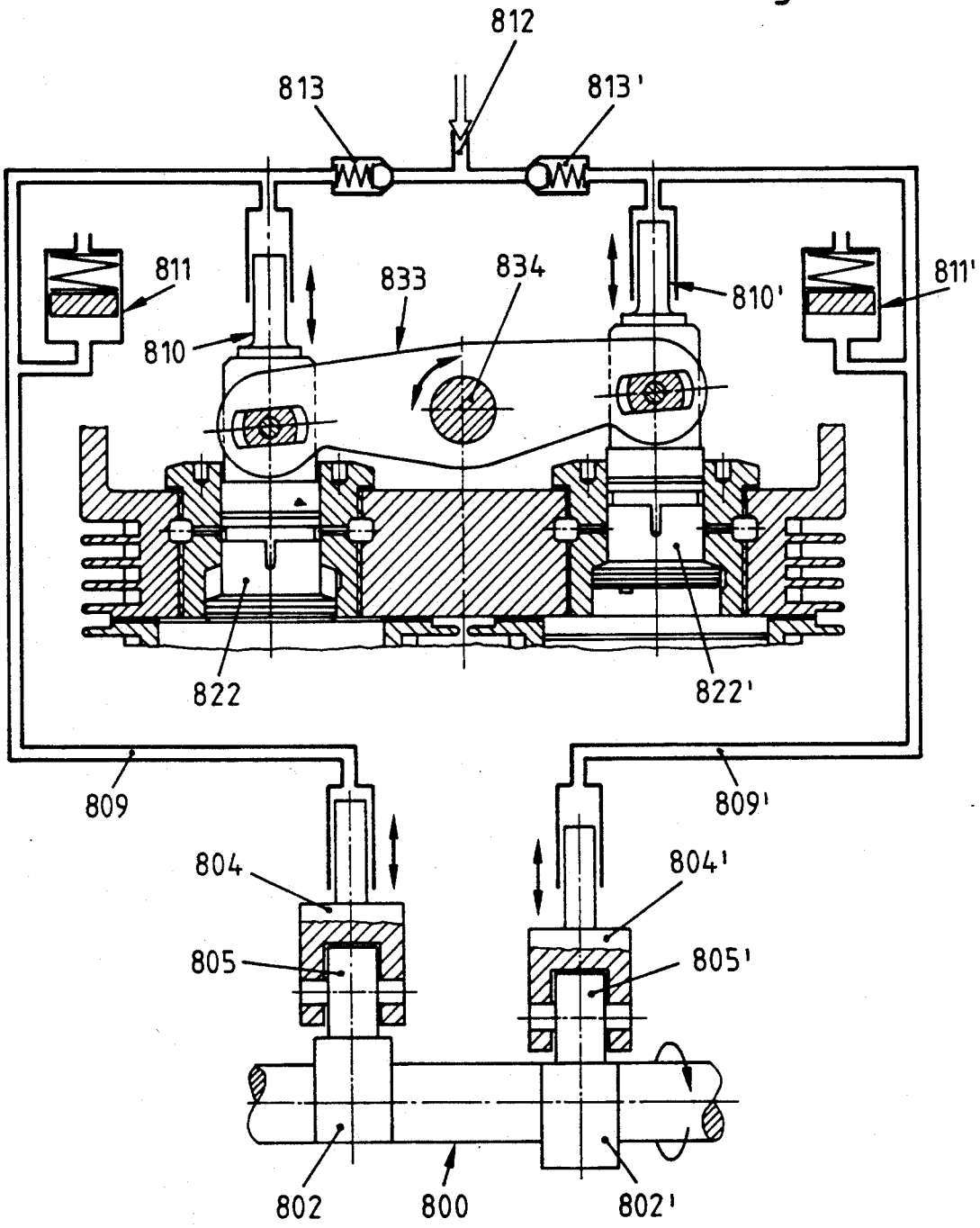
FIG. 13 is a construction as an alternative to the FIG. 10 configuration, of a hydraulically operative separate drive for two positively coupled compressor pistons derived from a cam shaft of the internal combustion engine.

While the constructions shown in FIGS. 10 through 12 involve mechanical transmission of the movements derived from a cam shaft for the separate drive of the differential pistons of the fuel compressors, FIG. 13 shows a separate drive arrangement with a hydraulic transmission system. Accordingly, the system comprises thrust members 804 and 804' which co-operate by way of cam follower rollers 805 and 805' with the eccentric cams 802 and 802' on the cam shaft 800 and which are in the form of hydraulic pumps operatively communicated with hydraulic cylinders 810 and 810' by way of a respective hydraulic line 809 and 809'. The cylinders 810 and 810' directly engage the projections of the compressor pistons 822 and 822' which are positively coupled by means of a rocking lever 833 mounted pivotably about a mounting shaft or spindle 834, for driving the pistons 822 and 822' in dependence on the supply of hydraulic fluid to the cylinders 810 and 810' respectively. The ends of the rocking lever 833 are connected to the projections on the compressor pistons by way of sliding members carried in longitudinal sliding guides, in the manner described above with reference to FIG. 6. Each of the hydraulic fluid systems is additionally equipped with an adjustable damper 811 and 811' and the two systems are connected to a common hydraulic fluid supply line 812 by way of check valves 813 and 813' which permit the systems to be filled with hydraulic fluid but which close off the systems in the direction towards the supply line 812.

It will be noted in relation to the above-described constructions involving cams providing for the separate drive that the cams may be of such a configuration that the supply of fuel to the respective combustion chambers of the engine in accordance with the invention occurs in accordance with a predetermined law in that respect.

It will be appreciated that the above-described constructions have been set forth solely by way of example and illustration of the principles of the present invention and that various modifications and alterations may be made therein without thereby departing from the spirit and scope of the present invention.

I claim:

1. An internal combustion piston engine comprising: at least first and second working cylinders associated with each other; working pistons accommodated in respective ones of the mutually associated working cylinders movably in mutually opposite relationship; and a fuel supply system which for compression of fuel includes for each working cylinder a piston-type compressor having a compression chamber and associated with the respective working cylinder at the cylinder head end thereof, the compressor comprising a compressor cylinder and a differential piston axially movably accommodated therein and providing a first area adapted to be subjected to the pressure in the combustion chamber of the associated working cylinder and providing a second area which is smaller than said first area and adapted to compress the fuel when the pressure in the combustion chamber of the associated working cylinder rises, the fuel supply system further including at least one flow transfer path between the compression chamber of the compressor and the combustion chamber of the associated working cylinder and adapted to provide at least one opening into said combustion chamber, said opening being disposed in the path of movement of the differential piston and adapted to be closed and opened thereby, and means for positively coupling the differential pistons of the respective compressors of said mutually associated working cylinders in mutually opposite relationship.

2. An engine as set forth in claim 1 wherein said positive coupling means for said mutually associated cylinders comprises a respective rocking lever for mechanically positively coupling said differential pistons of the associated working cylinders in opposite relationship.

3. An engine as set forth in claim 2 including a pivot mounting means for mounting said rocking lever pivotally about an axis extending at least substantially perpendicularly to the axes of the respective compressor cylinders, wherein the rocking lever has first and second ends pivotally connected to respective ones of the compressor pistons of the mutually associated working cylinders, and further including automatically operative means provided in the pivotal connection region between said compressor pistons and said rocking lever ends, for compensating for constraints in the movement of the rocking lever.

4. An engine as set forth in claim 3 wherein said compensating means include self-adjusting eccentric bearing members in the pivotal connections between the rocking lever ends and the respective compressor pistons, each eccentric bearing means comprising an eccentric sleeve accommodating a bearing journal member therein.

5. An engine as set forth in claim 4 wherein said eccentric sleeve is freely rotatably accommodated in a bearing opening in said rocking lever.

6. An engine as set forth in claim 4 wherein said eccentric sleeve is freely rotatably accommodated in a bearing opening in the compressor piston.

7. An engine as set forth in claim 3 wherein said compensating means comprises a sliding member operatively disposed between the respective rocking lever end and the respective compressor piston, means for movement of said sliding member transversely with respect to the movement of the respective compressor piston, and a bearing journal means extending through said sliding member to provide the pivot connecting axis of the assembly.

8. An engine as set forth in claim 7 wherein said means for movement of said sliding member comprises a guide slot means extending in the respective end of said rocking lever in the longitudinal direction thereof, and wherein the respective said bearing journal means is fixedly connected to the respective compressor piston.

9. An engine as set forth in claim 3 and further including a respective link means pivotally connected to a respective end of said rocking lever and to a respective said compressor piston, the link means extending substantially in the axial direction of the associated compressor cylinder, thereby pivotally to connect the respective end of the rocking lever to the respective compressor piston.

10. An engine as set forth in claim 9 wherein said link means comprises first and second ends and a ball joint means at one end and a connecting journal means at the other end.

11. An engine as set forth in claim 10 wherein the end of said link means which is towards the respective compressor piston carries a bearing ball and the respectively associated compressor piston has a bearing socket means adapted to movably accommodate the respective ball.

12. An engine as set forth in claim 3 wherein each said compressor piston has a projection portion thereon extending away therefrom on the side remote from the associated working cylinder, each projection portion being pivotally connected to a respective end of the associated rocking lever.

13. An engine as set forth in claim 2 wherein the ends of said rocking lever constitute respective toothed segments and the compressor pistons of the respective mutually associated working cylinders afford toothed racks which are in meshing engagement with respective ones of said toothed segments.

14. An engine as set forth in claim 2 and further comprising a cam shaft, and a separate drive derived from said cam shaft for the differential pistons of the compressors.

15. An engine as set forth in claim 14 wherein said separate drive comprises a drive rocking lever, a mounting shaft means on which said first-mentioned rocking lever for positively coupling the compressor pistons and the drive rocking lever are non-rotatably mounted, and an actuating arrangement adapted to actuate the drive rocking lever from said cam shaft.

16. An engine as set forth in claim 14 wherein the separate drive for each said compressor includes a drive rocking lever adapted to be actuated by said cam shaft and adapted to engage the respective differential piston.

17. An engine as set forth in claim 16 wherein said cam shaft is disposed above the respective rocking lever and the rocking lever carries a cam follower roller means co-operable with a cam on the cam shaft.

18. An engine as set forth in claim 17 and further including an adjustable pivot mounting means for supporting the end of the separate drive rocking lever which is remote from the differential piston of the respective compressor.

19. An engine as set forth in claim 18 comprising adjustable plunger slide means providing said adjustable pivot mounting means.

20. An engine as set forth in claim 14 and including a hydraulically operative separate drive having for each working cylinder a respective pump, a cam operable to drive the pump, and a hydraulic cylinder operatively connected to the respective pump and operable to displace a respective compressor piston.

21. An engine as set forth in claim 20 and further including an adjustable damping means disposed in the communication between each said pump and the associated hydraulic cylinder.

22. An engine as set forth in claim 14 including means for varying the angle of rotation of the cam shaft relative to the crankshaft of the engine for selectively varying the beginning of the supply of fuel to the combustion chambers of the working cylinders.

23. An engine as set forth in claim 14 wherein the cams of the cam shaft of the separate drive are of such a configuration that the supply of fuel to the combustion chambers of the working cylinders occurs in accordance with a predetermined law.

* * * * *